US007775410B2

(12) United States Patent
Zamzow

(10) Patent No.: US 7,775,410 B2
(45) Date of Patent: Aug. 17, 2010

(54) BOOT HOLDING DEVICES

(75) Inventor: Lindsay J. Zamzow, Golden Valley, MN (US)

(73) Assignee: Boottique, Inc., Minneapolis, MN (US)

( * ) Notice: Subject to any disclaimer, the term of this patent is extended or adjusted under 35 U.S.C. 154(b) by 102 days.

(21) Appl. No.: 11/940,384

(22) Filed: Nov. 15, 2007

(65) Prior Publication Data

US 2008/0116235 A1 May 22, 2008

Related U.S. Application Data

(60) Provisional application No. 60/866,122, filed on Nov. 16, 2006.

(51) Int. Cl.
*A41D 27/22* (2006.01)

(52) U.S. Cl. ..... 223/85; 211/34

(58) Field of Classification Search ..... 223/85, 223/88, 90, 91, 93, 96; 211/34
See application file for complete search history.

(56) References Cited

U.S. PATENT DOCUMENTS

| | | | | | |
|---|---|---|---|---|---|
| 283,418 | A | | 8/1883 | Ries | |
| 1,286,595 | A | * | 12/1918 | Jacobs | 223/85 |
| 1,421,709 | A | * | 7/1922 | Nelson | 211/119 |
| 1,786,341 | A | * | 12/1930 | Gilbert | 223/98 |
| 2,278,258 | A | * | 3/1942 | Gillett | 211/34 |
| 2,506,510 | A | * | 5/1950 | Longwell et al. | 223/91 |
| 2,556,530 | A | * | 6/1951 | Fichman | 223/90 |
| 2,675,130 | A | * | 4/1954 | Dore | 211/119 |
| 2,703,651 | A | * | 3/1955 | Brocklehurst | 211/34 |
| 2,817,471 | A | * | 12/1957 | Stoschy | 223/90 |
| 2,920,800 | A | * | 1/1960 | Kassardjian | 223/88 |
| 3,249,231 | A | | 5/1966 | Matlock | |
| D209,799 | S | * | 1/1968 | Stubbs | 223/85 |
| 4,576,290 | A | * | 3/1986 | Zigman | 211/34 |
| 4,669,615 | A | * | 6/1987 | Zigman | 211/34 |
| 4,953,715 | A | * | 9/1990 | Celli | 211/34 |
| 5,163,590 | A | | 11/1992 | Lawler et al. | |
| 5,224,607 | A | * | 7/1993 | Koresko | 211/34 |
| 5,294,007 | A | | 3/1994 | Edmondson | |
| 5,911,347 | A | * | 6/1999 | Jackstat et al. | 223/85 |
| D417,556 | S | | 12/1999 | Schell | |
| D438,022 | S | | 2/2001 | Bunn | |
| 2008/0000935 | A1 | * | 1/2008 | Austin | 223/85 |

* cited by examiner

*Primary Examiner*—Gary L Welch
*Assistant Examiner*—Nathan E Durham
(74) *Attorney, Agent, or Firm*—Fredrickson & Byron, P.A.

(57) ABSTRACT

A hanger includes first and second holding members, for reversibly grasping a pair of boots, which members are spaced apart from one another along a first axis and along a second axis, the first being approximately orthogonal to the second, and both the first and second being approximately orthogonal to vertical. This spacing allows the pair of boots to be held side-by-side so that a heel portion of one boot of the pair is approximately aligned with an arch portion of the mating boot. The hanger may include a neck and a pair of arms, which extend from the neck to support the holding members, and the neck and arms of the hanger may be formed from a single piece of wire. A holding device may include both the hanger and a covering to fit around the boots held by the hanger.

19 Claims, 7 Drawing Sheets

BOOT HOLDING DEVICES

PRIORITY CLAIM

The present application claims priority to provisional application Ser. No. 60/866,122 filed on Nov. 16, 2006, which is hereby incorporated, by reference, in its entirety.

TECHNICAL FIELD

The present invention pertains to holding devices and more particularly to devices for holding a pair of boots.

BACKGROUND

Organizations, families, couples and even individuals may have a need for storing and/or transporting multiple pairs of boots, ranging from the sturdy work and/or cold weather types to the more supple and fashionable types. Although racks and/or hanger systems have been designed for holding boots, there is still a need for more functional and space-conscious storage/transport options that accommodate a variety of boot types.

BRIEF DESCRIPTION OF THE DRAWINGS

The following drawings are illustrative of particular embodiments of the invention and therefore do not limit the scope of the invention. The drawings are not to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention.

Figure 1B:
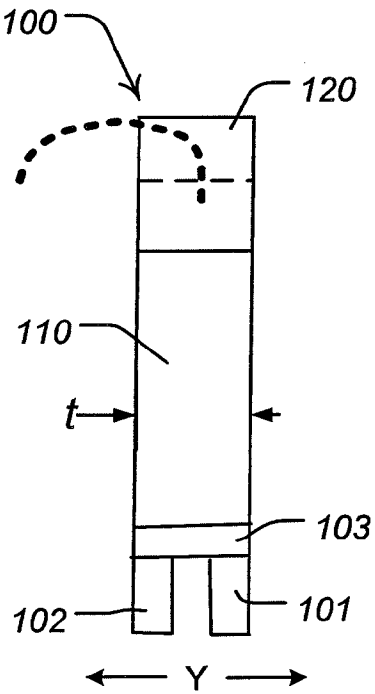
FIGS. 1A-C are front elevation, side elevation and top views, respectively, of a boot hanger, according to some embodiments of the present invention.
Figure 1C:
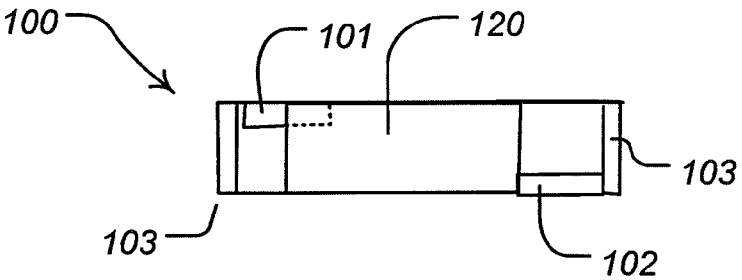
Figure 1A:
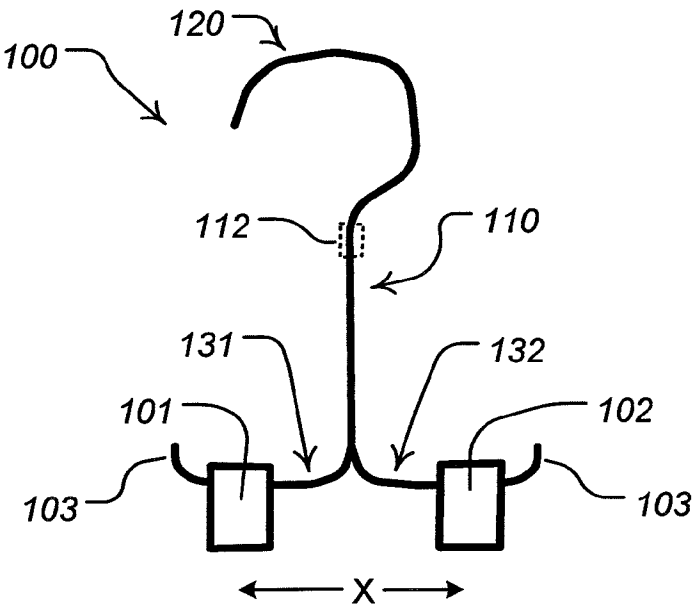

FIGS. 1A-C are a front elevation view, a side elevation view and a top view, respectively, of a boot hanger 100, according to some embodiments of the present invention. FIGS. 1A-C illustrate hanger 100 including a hook 120, a neck 110 extending downward from hook 120, a first arm 131 extending from a first side of neck 110, a second arm 132 extending in an opposite direction, from a second side of neck 110, a first holding member 101 supported by first arm 131, and a second holding member 102 supported by second arm 132. Holding members 101, 102 may be of any type that are adapted to reversibly capture or grasp a leg portion of a boot, either by insertion therein, for a friction fit, or by clamping to an exterior surface thereof, for example as is illustrated in FIG. 1D.

Figure 1E:
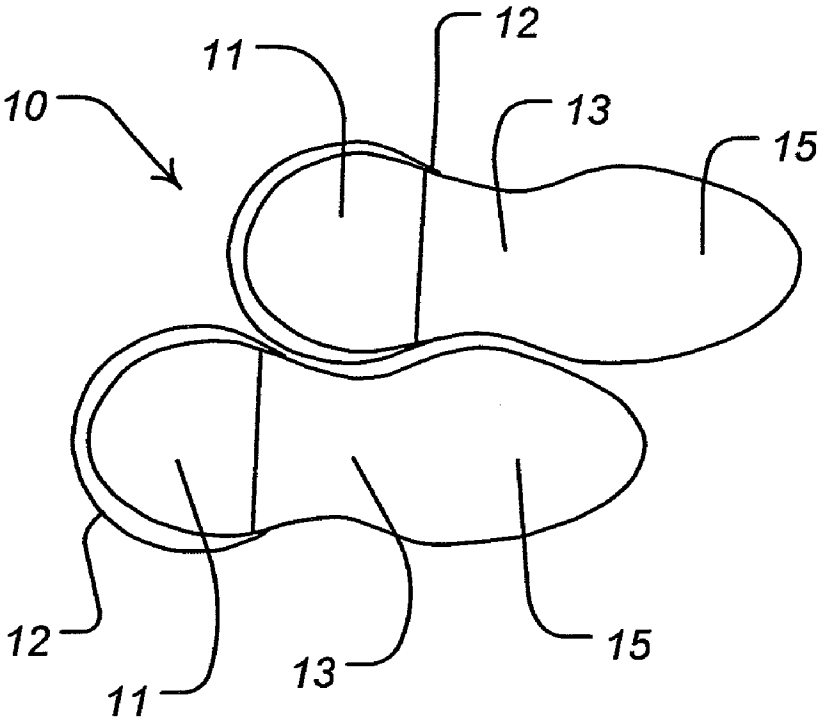
FIG. 1E is a bottom view of the pair of boots, shown in FIG. 1D, being held by the hanger.
Figure 1D:
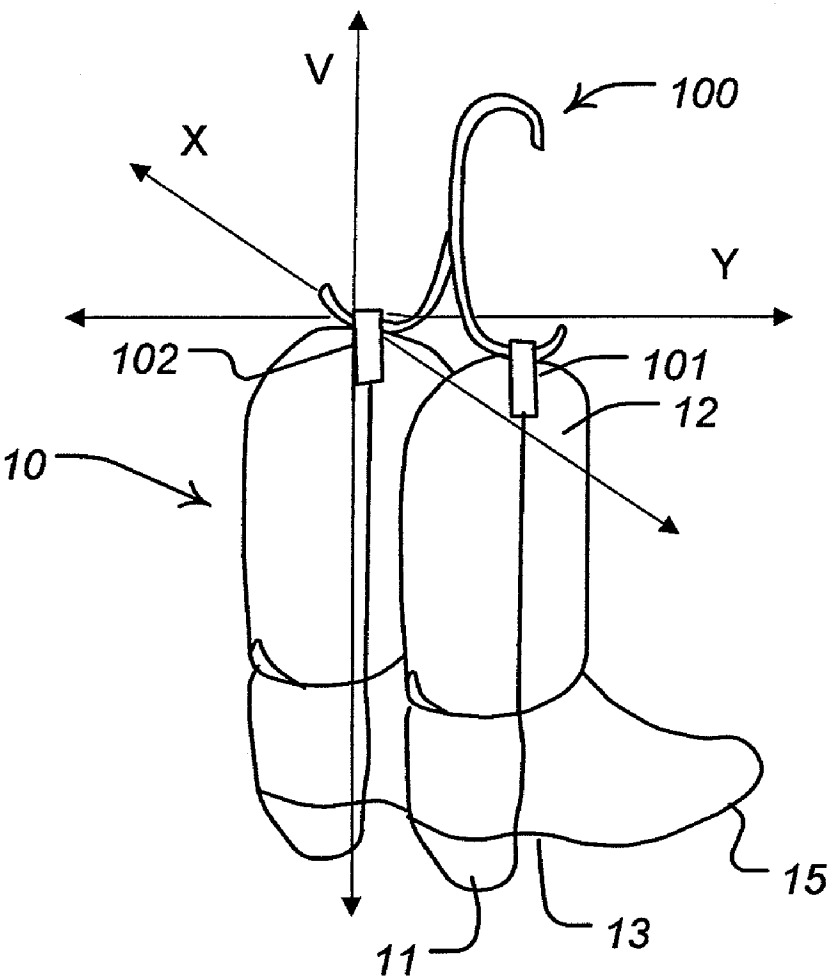
FIG. 1D is a perspective view of the hanger of FIGS. 1A-C holding a pair of boots.

FIG. 1D is a perspective view of boot hanger 100 holding a pair of boots 10; and FIG. 1E is a bottom view of pair of boots 10 being held by hanger 100. FIGS. 1D-E illustrate each boot of pair 10 including a heel portion 11, a leg portion 12, extending from heel portion, and an arch portion 13 joining heel portion 11 to a toe portion 15. With reference to FIGS. 1D-E, it may be appreciated how a spacing of holding members 101, 102 allows pair of boots 10 to be hung side-by-side, such that heel portion 11 of one boot of pair 10 is approximately aligned with arch portion 13 of the mating boot of pair 10. According to the illustrated embodiment, first holding member 101 is spaced apart from second holding member 102 along a first axis X and along a second axis Y. First axis X and second axis Y are approximately orthogonal to one another, and both axes X and Y are approximately orthogonal to an axis V, which is vertical when hanger 100 is hung to hold boots 10. Although embodiments of the present invention are not limited to a particular spacing between members 101, 102, a distance between holding members 101,102, along axis X, may range from approximately 3 inches to approximately 6 inches, and a distance between holding members 101, 102, along axis Y, may range from approximately 1 inch to approximately 3 inches.

Figure 2B:
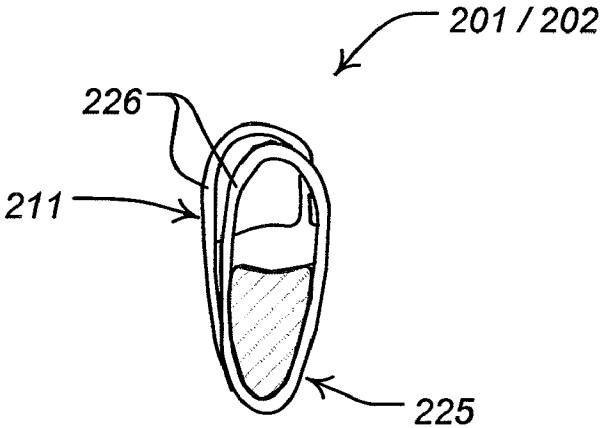
FIGS. 2B-C are perspective views of alternate embodiments of holding members that may be employed by embodiments of the present invention.

According to some embodiments, one of first and second arms 131, 132 may be integral with neck 110 and hook 120, that is, formed out of a same piece as that of neck 110 and hook 120, while the other of first and second arms 131, 132 is formed of a separate piece that is coupled to neck 110. An example of such an embodiment is illustrated in FIGS. 2A-B and will be described below. According to some other embodiments, hook 120 may also be formed of a separate piece, which is joined to neck at a junction 112 shown with dashed lines in FIG. 1A; junction 112 may allow rotation of hook 120 with respect to neck 110 and arms 131, 132, for example, as illustrated, with dashed lines, in FIG. 1B, wherein a plane in which hook 120 curves is approximately orthogonal to a plane in which arms 131, 132 extend. According to yet further embodiments, hook 120 is fixed in the alternative orientation shown by the dashed lines of FIG. 1B.

FIG. 2A is a perspective view of a hanger 200 according to some embodiments of the present invention. FIG. 2A illustrates hanger 200 including a hook 220, a neck 210 extending downward from hook 220, a first arm 231 extending from a first side of neck 210, a second arm 232 extending in an opposite direction, from a second side of neck 210, a first holding member 201 supported by first arm 231, and a second holding member 202 supported by second arm 232. FIG. 2A further illustrates a first piece 251 of hanger 200, which is formed into hook 220, neck 210 and first arm 231, and a second piece 252 of hanger 200, which is formed into second arm 232 and is coupled to neck 210, for example, via welding. According to the illustrated embodiment, each of pieces 251, 252 is formed from a piece of wire doubled back on itself to provide a depth, or thickness, for arms 231, 232 that facilitates the spacing of holding members 201, 202 from one another along axis Y. It should be noted that embodiments of the present invention can alternately incorporate ribbon-like strips, which have a thickness t (FIG. 1B), in place of wire or in combination with wire. Each arm 231, 232 is also shown bending upward to terminate at ends 203, for example, to limit the spacing between each holding member 201, 202 along axis X; however, upturned ends 203 are not necessary features for all embodiments of the present invention.

Figure 2C:
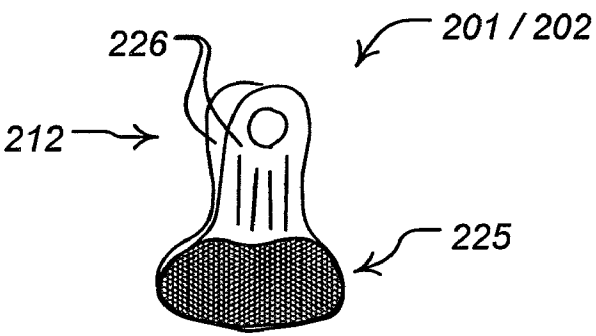
Figure 2A:
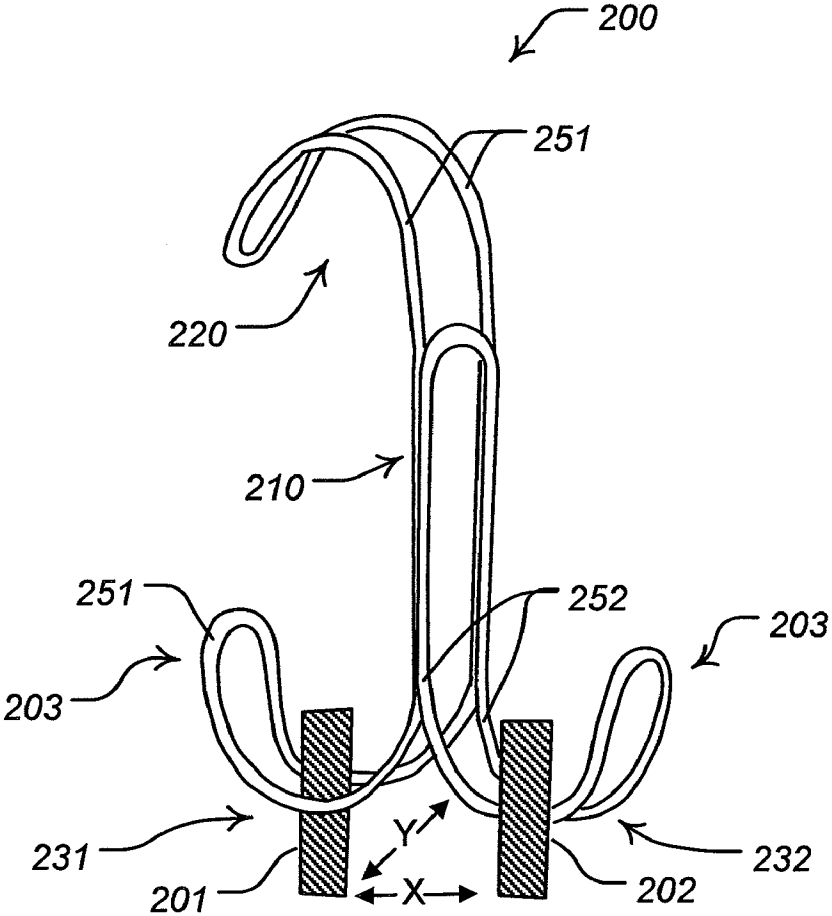
FIG. 2A is a perspective view of a boot hanger, according to some embodiments of the present invention.

FIGS. 2B-C are perspective views of alternate embodiments of holding members 201, 202. FIGS. 2B-C illustrate clips 211 and 212, respectively, such as are known in the art. Each of clips 211, 212 includes opposing spring-loaded arms 226 that are terminated in gripping portions 225 for reversibly grasping leg portions of boots; clips 211, 212 may be formed from plastic or metal, and FIG. 2C, which illustrates a metal embodiment, further illustrates gripping portions 225 coated with a rubber or thermoplastic material. Preferably, such spring-loaded clips, incorporated by embodiments of the present invention, will include gripping interfaces that will not leave permanent marks on an exterior surface of the leg portion of the boot held within the gripping portion of each clip.

Figure 3B:
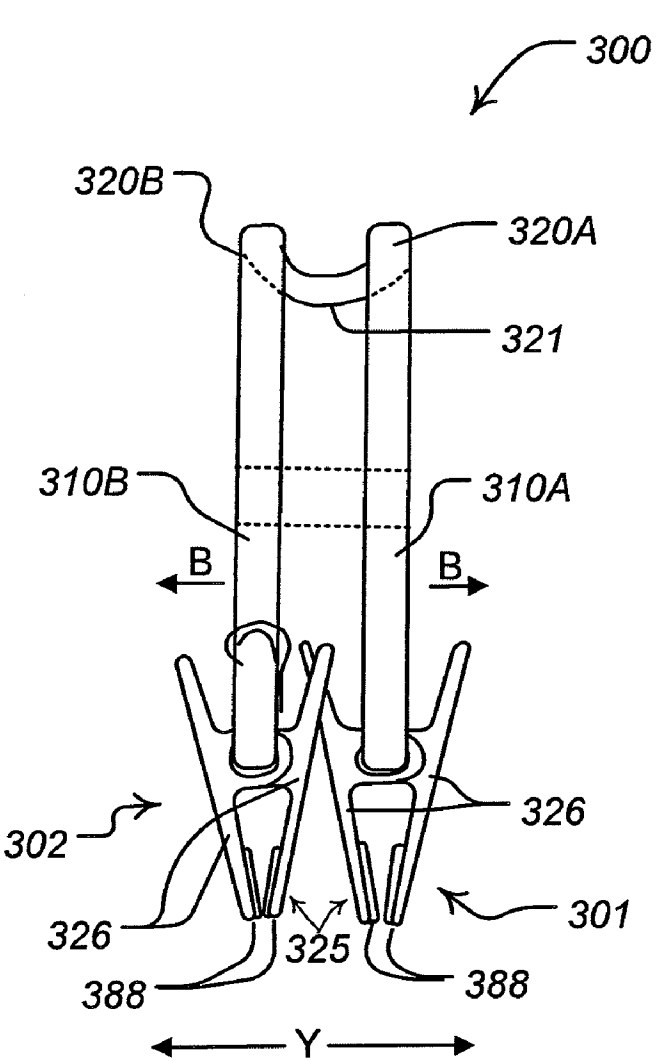
FIGS. 3A-B are front and side elevation views, respectively, of a hanger according to some preferred embodiments of the present invention.
Figure 3A:
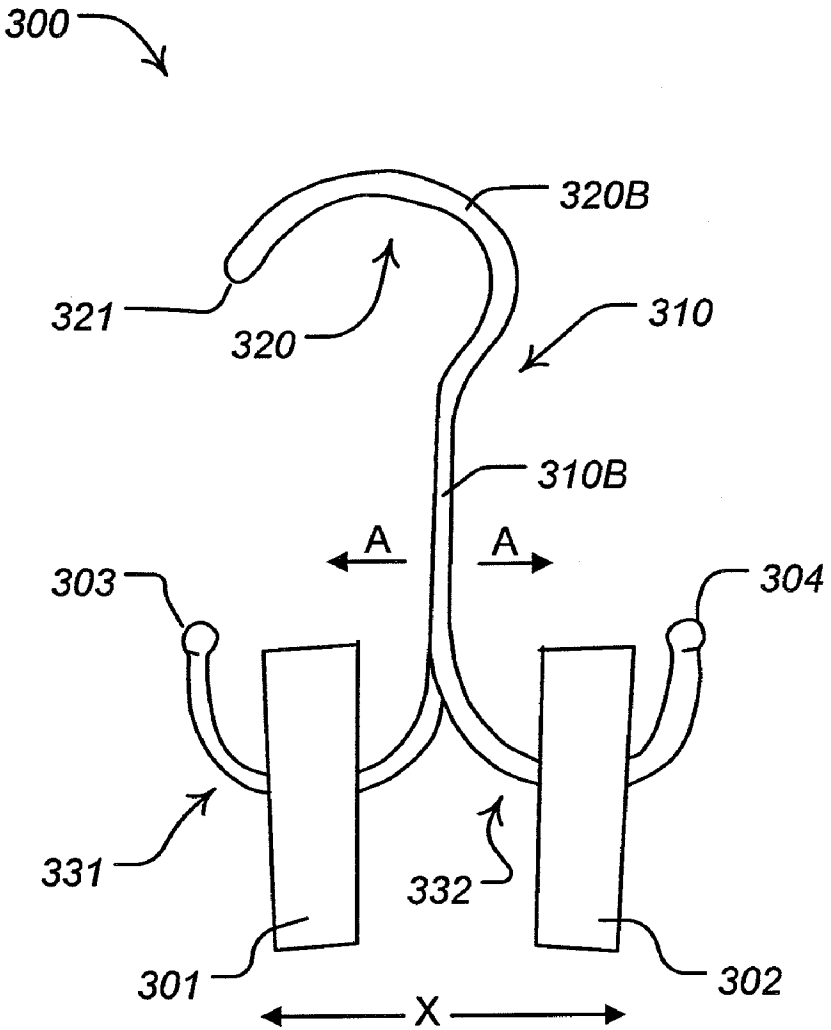

FIGS. 3A-B are front and side elevation views of a hanger 300 according to some preferred embodiments of the present invention. FIGS. 3A-B illustrate hanger 300 including a hook 320, a neck 310 extending downward from hook 320, a first arm 331 extending from a first side of neck 310, a second arm 332 extending, in an opposite direction, from a second side of neck 310, a first holding member 301 supported by first arm 331, and a second holding member 302 supported by second arm 332. According to the illustrated embodiment, hanger 300 is formed from a single piece of wire that extends from a first end 303 of first arm 331 to a second end 304 of second arm 332. A rubber cap may be mounted on each end 303, 304. With reference to FIGS. 3A-B, it may be appreciated that the wire forming hanger 300 extends in a first plane to form first arm 331, a first part 310A of neck 310, and a first part 320A of hook 320, and then traverses over to a second plane, at an end 321 of hook 320, to form a second part 320B of hook 320, a second part 310B of neck 310 and second arm 332.

Preferably the wire forming hanger 300 is a metal wire, for example stainless steel or aluminum, having sufficient stiffness to prevent splaying of arms 331, 332 along either axis Y or axis X, when boots are being held by hanger 300. However, according to some embodiments, the wire of hanger 300 will allow arms 331, 332 to be forcibly plastically deformed in order to adjust a spacing of arms 331, 332 along both axis X, for example, according to arrow A (FIG. 3A), and axis Y, for example, according to arrow B (FIG. 3B), so that hanger 300 may accommodate various boot sizes and boot leg thicknesses. According to some alternate embodiments, a brace (shown by dashed lines in FIG. 3B) may be included to help prevent unintended splaying of arms 331, 332. According to an exemplary embodiment of the present invention, an approximately round cross-section stainless steel wire having a diameter of approximately 0.156 inch is used to form the hooks, neck and arms of hangers 200, 300. However, it should be noted that the wire used for hangers 200, 300 may be of any material having sufficient strength and stiffness to hold the form of hangers 200, 300 under loading conditions typical for hanging a pair of boots.

Figure 3C:
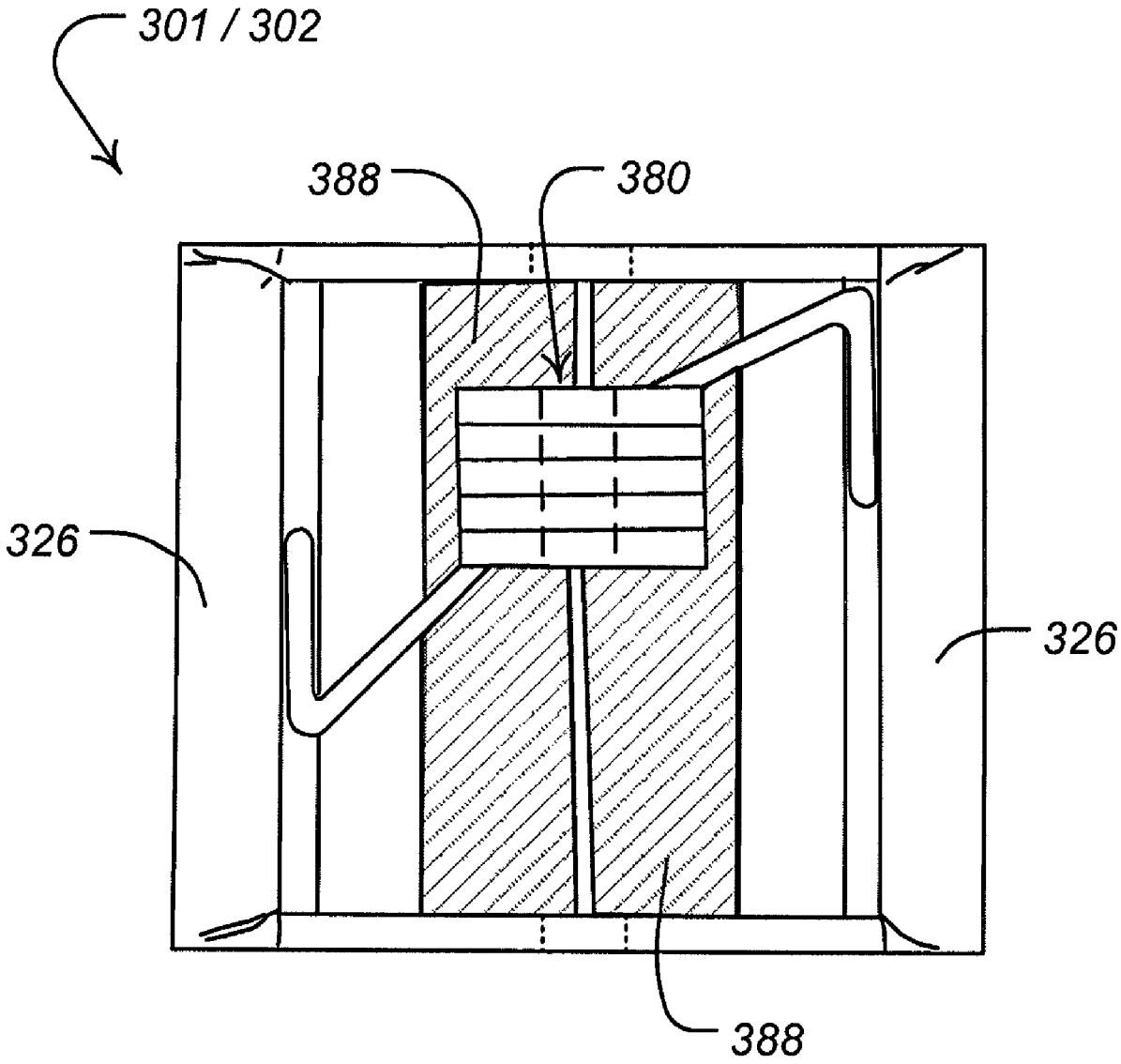
FIG. 3C is top view of a holding member that may be employed by embodiments of the present invention.

FIG. 3B further illustrates holding members 301, 302 including opposing spring-loaded arms 326 terminated in gripping portions 325, for reversibly grasping leg portions of boots. FIG. 3C is a top view of one of holding members 301, 302 showing a coiled spring member 380 mounted between opposing arms 326 of member 301/302; the coiled portion of spring member 380 fits about either of arms 331, 332 of hanger 300. According to preferred embodiments, clip arms 326 and spring member are formed from a metal, and gripping interfaces 388, which are each attached to an internal surface of gripping portions 325, are formed from a relatively hard polymer material and have relatively smooth surfaces to facilitate gripping without irreversibly marking the exterior surfaces of boots.

Any portion of any embodiment described herein may further incorporate surface treatments and/or coatings providing alternative surface textures and/or colors, for example, chrome coatings or polymer coatings.

Figure 4:
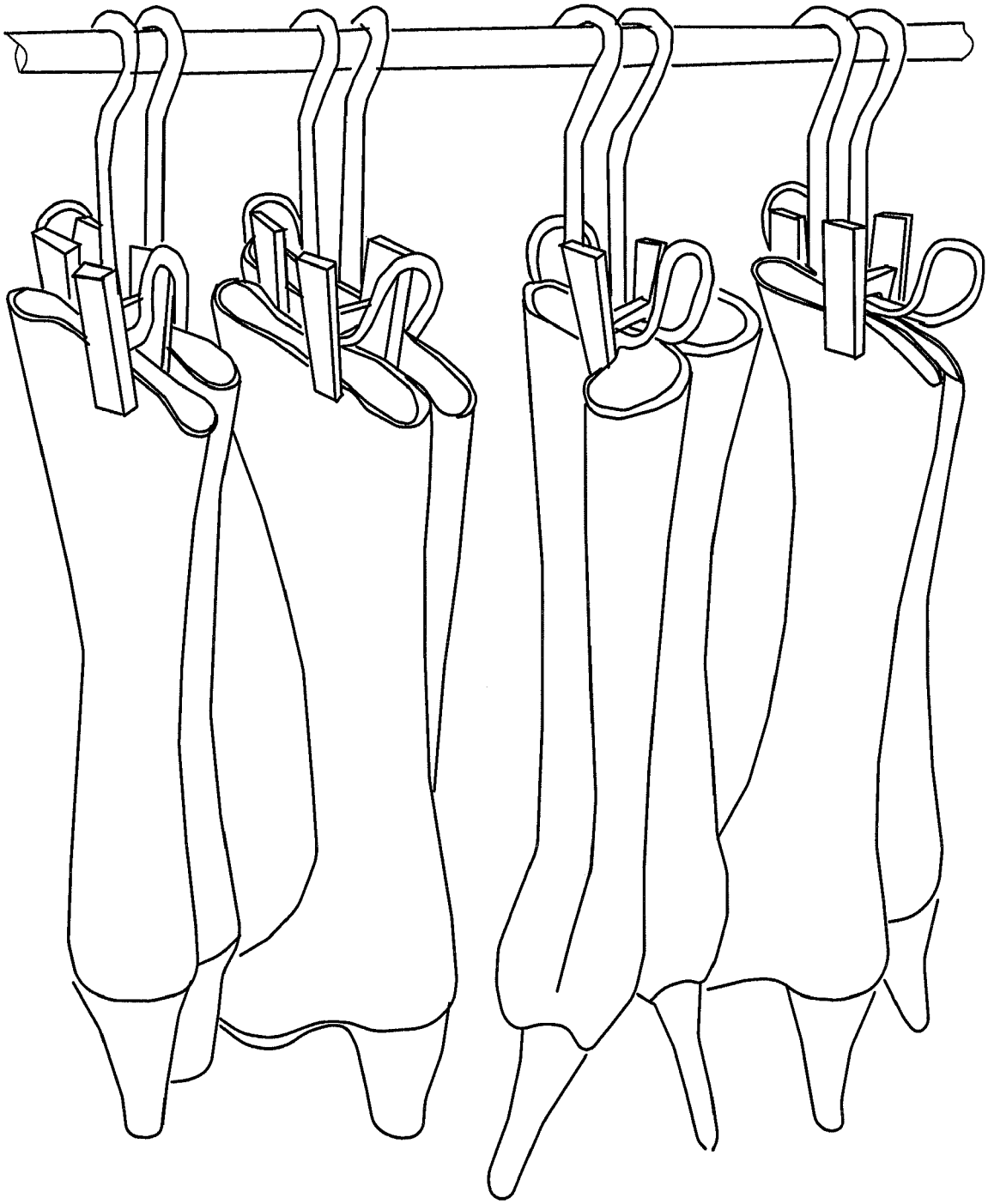
FIG. 4 is a schematic of a portion of a closet incorporating some boot hangers of the present invention.

FIG. 4 is a schematic of a portion of a closet incorporating multiple boot hangers, of one embodiment of the present invention, to hang a plurality of pairs of boots. With reference to FIG. 4, organizational and space-saving advantages provided by boot hangers of the present invention may be appreciated.

Figures 5A, 5B:
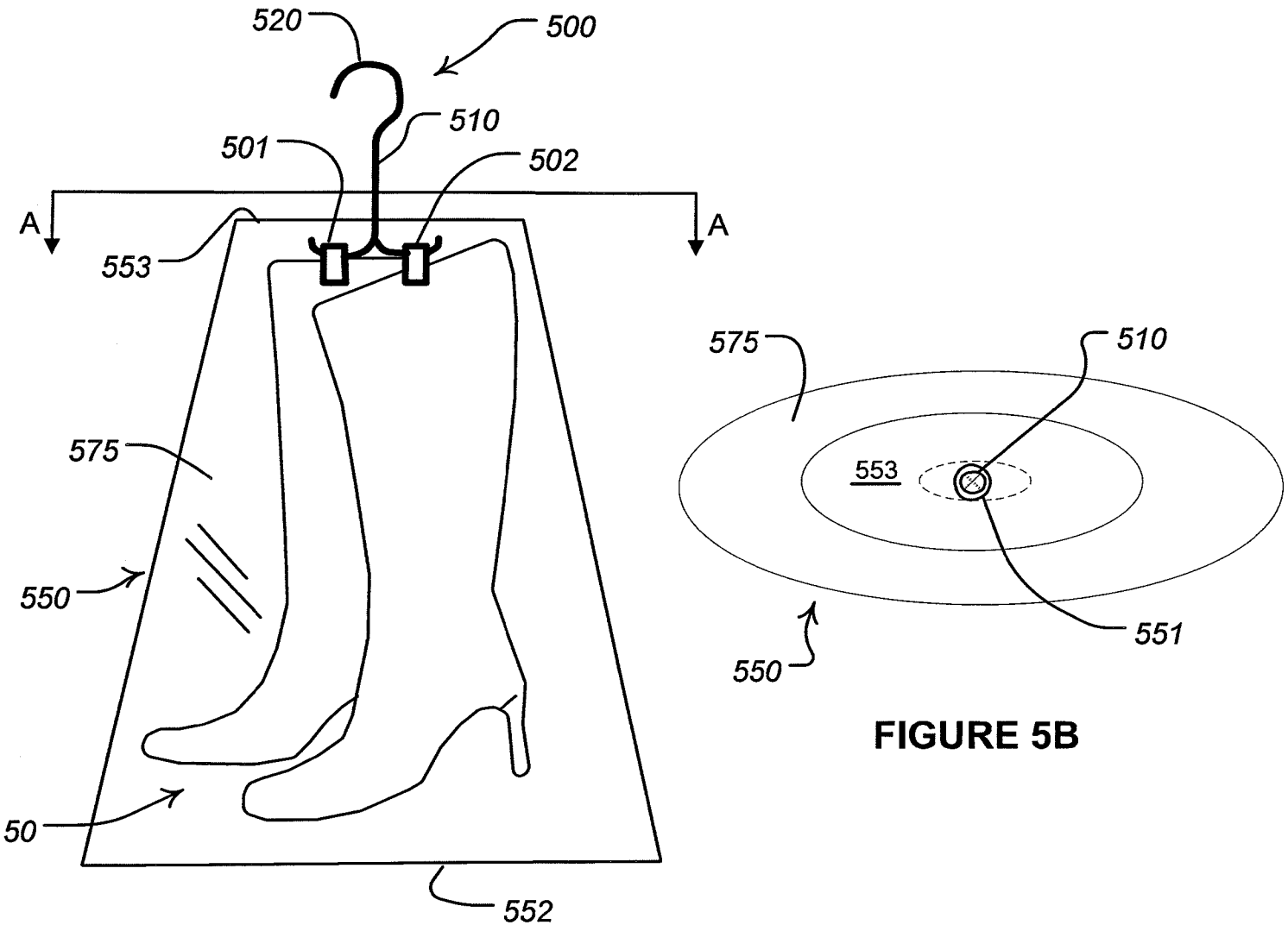
FIG. 5*a* is a schematic showing a pair of boots, held by a hanger and covered for storage by a covering, according to some embodiments of the present invention.
FIG. 5B is section view through a section line A-A of FIG. 5A.

FIG. 5A is a schematic showing a pair of boots 50, which are grasped by holding members 501, 502 of a hanger 500 and which are covered for storage by a covering 550; and FIG. 5B is section view through section line A-A of FIG. 5A. FIGS. 5A-B illustrate covering 550 including a top side 553 fitted about a neck 510 of hanger 500 and a sidewall 575 extending downward, from top side 553, and around holding members 501, 502 and boots 50. According to preferred embodiments, a bottom end 552 of covering 550 opens up to an interior thereof so that covering 550 may be slipped, from bottom end 552, over a hook 520 of hanger 500 and downward over boots 50. According to the illustrated embodiment, top side 553 of covering 550 includes an opening 551 being sized to just fit about a cross-section of hook 520 and neck 510; a relatively snug fit of opening 551 about neck 510 may be desired in order to prevent debris from entering the interior of covering 550. Dashed lines in FIG. 5B illustrate an alternate opening for top side 553 which will fit over a width of hook 520. For either of these openings, a draw string, or some other type of cinching-type mechanism, extending about edges thereof, may be employed to bring the edges of the opening snuggly together around neck 510. Additionally either opening on top side 553 may include a reinforced border to prevent tearing. Any suitable flexible material may be used to form covering 550, for example, woven or non-woven materials, being either cloth-like or polymer films. Although FIG. 5A illustrates covering 550 being transparent, non-transparent, or opaque materials may be employed for all or some portions of sidewall 575 and top side 553, according to alternate embodiments.

In the foregoing detailed description, the invention has been described with reference to specific embodiments. However, it may be appreciated that various modifications and changes can be made without departing from the scope of the invention as set forth in the appended claims.

I claim:

1. A hanger for holding a pair of boots, the hanger comprising:

a neck extending approximately vertically, when the hanger is hung to hold the pair of boots;

a first arm including an end, the first arm extending directly from a first side of the neck to the end of the first arm, in a first direction;

a second arm including an end, the second arm extending directly from a second side of the neck to an end of the second arm, in a second direction, the second direction being directly opposite to the first direction, such that the neck is located in between the extent of the first and second arms;

a first holding member for reversibly grasping a leg portion of a first boot of the pair of boots and being supported by the first arm; and a second holding member for reversibly grasping a leg portion of a second boot of the pair of boots and being supported by the second arm;

wherein the first and second arms support the first and second holding members so that the first and second holding members are spaced apart from one another along a first axis and along a second axis, the second axis being approximately orthogonal to the first axis, and the first and second axes being approximately orthogonal to vertical, when the hanger is hung to hold the pair of boots; and the supported spacing between the first and second holding members is sufficient to allow each of the holding members to grasp the leg portion of the corresponding boot of the pair of boots, so that, when the hanger is hung, the boots are held side-by-side, in a staggered manner, with a heel portion of the first boot approximately aligned with an arch portion of the second boot.

2. The hanger of claim 1, wherein each of the first and second holding members is slideably engaged with the corresponding arm of the first and second arms in order that the spacing of the holding members along the first axis may be adjusted.

3. The hanger of claim 1, wherein each of the first and second arms bends upward at the corresponding end, when the hanger is hung to hold the pair of boots.

4. The hanger of claim 1, wherein the first arm extends in a first plane and the second arm extends in a second plane, the first and second planes being approximately parallel with the first axis and the second plane being spaced apart from the first plane along the second axis.

5. The hanger of claim 1, wherein a position of the first arm is adjustable, with respect to a position of the second arm, in a direction approximately parallel with the first axis.

6. The hanger of claim 1, wherein a position of the first arm is adjustable, with respect to a position of the second arm, in a direction approximately parallel with the second axis.

7. The hanger of claim 1, wherein the neck and at least one of the first and second arms are integrally formed by a single wire.

8. The hanger of claim 1, further comprising a hook extending from the neck to hang the hanger.

9. The hanger of claim 8, wherein an orientation of the hook is fixed with respect to the first and second directions in which the first and second arms extend.

10. The hanger of claim 8, wherein an orientation of the hook is adjustable with respect to the first and second directions in which the first and second arms extend.

11. The hanger of claim 8, wherein the neck, the hook and the first and second arms are integrally formed by a single wire extending from the end of the first arm, to the end of the second arm.

12. The hanger of claim 1, wherein each of the first and second holding members comprises a pair of opposing spring-loaded arms.

13. A holding device for a pair of boots, the device comprising:

a boot hanger comprising:

a neck extending approximately vertical, when the hanger is hung to hold the pair of boots;

a first arm including an end, the first arm extending directly from a first side of the neck to the end of the first arm, in a first direction;

a second arm including an end, the second arm extending directly from a second side of the neck to the end of the second arm, in a second direction, the second direction being directly opposite to the first direction, such that the neck is located in between the extent of the first and second arms;

a first holding member for reversibly grasping a leg portion of a first boot of the pair of boots and being supported by the first arm; and a second holding member for reversibly grasping a leg portion of a second boot of the pair of boots and being supported by the second arm;

wherein the first and second arms support the first and second holding members so that the first and second holding members are spaced apart from one another along a first axis and along a second axis, the second axis being approximately orthogonal to the first axis, and the first and second axes being approximately orthogonal to vertical, when the hander is hung to hold the pair of boots; and the supported spacing between the first and second holding members is sufficient to allow each of the first and second holding members to grasp the leg portion of the corresponding boot of the pair of boots, so that, when the hanger is hung, the boots are held side-by-side, in a staggered manner, with a heel portion of the first boot approximately aligned with an arch portion of the second boot; and a covering including a top side, to fit about the neck of the hanger, a bottom end, and a sidewall extending between the top side and the bottom end, the sidewall to fit around the pair of boots, when the boots are grasped by the first and second holding members.

14. The device of claim 13, wherein the sidewall of the covering includes a transparent portion.

15. The device of claim 13, wherein each of the first and second holding members of the hanger is slideably engaged with the corresponding arm of the first and second arms in order that the spacing of the holding members along the first axis may be adjusted.

16. The device of claim 13, wherein a position of the first arm is adjustable, with respect to a position of the second arm, in at least one direction.

17. The device of claim 13, wherein the neck and at least one of the first and second arms of the hanger are integrally formed by a single wire.

18. The device of claim 13, wherein the hanger further comprises a hook extending from the neck to hang the hanger.

19. The device of claim 18, wherein the neck, the hook and the first and second arms of the hanger are integrally formed by a single wire extending from the end of the first arm, to the end of the second arm.

* * * * *